US008709237B2

(12) United States Patent
Stevens et al.

(10) Patent No.: US 8,709,237 B2
(45) Date of Patent: Apr. 29, 2014

(54) PROCESS AND SYSTEM FOR RECOVERY OF ASPHALTENE BY-PRODUCT IN PARAFFINIC FROTH TREATMENT OPERATIONS

(75) Inventors: Geoff Stevens, Calgary (CA); Ray Reipas, Calgary (CA)

(73) Assignee: Total E&P Canada Ltd, Calgary (CA)

( * ) Notice: Subject to any disclaimer, the term of this patent is extended or adjusted under 35 U.S.C. 154(b) by 1115 days.

(21) Appl. No.: 12/582,662

(22) Filed: Oct. 20, 2009

(65) Prior Publication Data

US 2010/0096297 A1 Apr. 22, 2010

Related U.S. Application Data

(60) Provisional application No. 61/107,617, filed on Oct. 22, 2008.

(51) Int. Cl.
*C10G 21/14* (2006.01)
*C10C 3/08* (2006.01)

(52) U.S. Cl.
USPC ..... 208/312; 208/45; 208/309; 208/311; 208/337; 208/390

(58) Field of Classification Search
USPC ..... 208/390, 45, 309, 311, 312, 322, 337
See application file for complete search history.

(56) References Cited

U.S. PATENT DOCUMENTS 6,007,709 A 12/1999 Duyvesteyn
6,214,213 B1 4/2001 Tipman et al.
2006/0196812 A1* 9/2006 Beetge et al. ..... 208/435
2006/0272982 A1* 12/2006 Montanari et al. ..... 208/86
2010/0089800 A1* 4/2010 MacDonald et al. ..... 208/390

FOREIGN PATENT DOCUMENTS

CA 2149737 11/1996
CA 2232929 9/1998
CA 2217300 3/1999
CA 2454942 7/2005
CA 2521248 3/2007

OTHER PUBLICATIONS

Shelfantook, W. E. "A Perspective on the Selection of Froth Treatment Processes" Canadian Journal of Chemical Engineering, vol. 82 Aug. 2004.
Romanova et al. "Investigation of Oil Sands Froth Treatment" Canadian Journal of Chemical Engineering, vol. 82 Aug. 2004.

(Continued)

*Primary Examiner* — Renee E Robinson
(74) *Attorney, Agent, or Firm* — Sean W Goodwin

(57) ABSTRACT

A process for treating bitumen froth with paraffinic solvent is provided which uses three stages of separation. Froth and a first solvent are directed to a first stage at a solvent/bitumen ratio for precipitating few or substantially no asphaltenes. A first stage underflow is directed to a second stage and a first stage overflow is directed to a third stage. A second stage underflow is directed to waste tailings and the second stage overflow joins the first stage overflow. A third stage underflow is recovered as an asphaltene by-product and a third stage overflow is recovered as a diluted bitumen product. At least a second solvent is added to one or both of the second or third stages for controlling a fraction of asphaltenes in the third stage underflow. Asphaltene loss to waste tailings is minimized and asphaltenes are now recovered as asphaltene by-product.

21 Claims, 2 Drawing Sheets

(56) References Cited

OTHER PUBLICATIONS

Long et al. "Selective Solvent Deasphalting for Heavy Oil Emulsion Treatment" Chapter 20 in 'Asphaltenes. Heavy Oils, and Petroleomics', Springer 2007.

Masliyah, J. H. "Froth Treatment" Oil Sands Extracting and Upgrading—Intensive Short Course, Calgary AB, Jun. 2009.

Akbarzadeh, K. "A Generalized Regular Solution Model for Asphaltene Precipitation From N-Alkane Diluted Heavy Oils and Bitumens" Fluid Phase Equilibria 232 (2005) 159-170.

* cited by examiner

PROCESS AND SYSTEM FOR RECOVERY OF ASPHALTENE BY-PRODUCT IN PARAFFINIC FROTH TREATMENT OPERATIONS

CROSS-REFERENCE TO RELATED APPLICATIONS

This application claims the benefit of U.S. Provisional Patent application Ser. No. 61/107,617, filed Oct. 21, 2008, the entirety of which are incorporated herein by reference.

FIELD OF THE INVENTION

The invention relates to the separation of bitumen, solvent, water, solids and asphaltenes in a paraffinic froth treatment process. More particularly, solvent is added to the influent of each of at least two stages of three stages of separation. The overflows of the first and second stages combine at the third stage for recovery of a diluted bitumen product stream and an asphaltene by-product stream.

BACKGROUND OF THE INVENTION

Recovery of bitumen from mined oilsands involves separation of a bitumen-rich froth from an oilsand slurry, and treatment of the froth to remove impurities and produce a marketable product. Known paraffinic froth treatment processes involve the addition of a paraffinic solvent to the bitumen-rich froth which enables separation of the mineral and water contaminants and production of a marketable bitumen product. Asphaltenes in the bitumen precipitate if sufficient paraffinic solvent is mixed with froth. In a froth settler vessel the precipitated asphaltenes settle along with the mineral and water contaminants. This gravity settling process separates the diluted froth into two streams; a diluted bitumen product at a top and an underflow at a bottom. The underflow is a mixture of solids, water, bitumen, solvent and precipitated asphaltenes.

Typically, the paraffinic froth treatment process can be sub-divided into three components: froth settler/separation, solvent recovery and tailings solvent recovery. After the froth settling/separation, the diluted bitumen product is sent to a solvent recovery unit (SRU) where solvent is recovered for re-use and clean bitumen is obtained as the feed to an upgrading process. Underflow from froth settling/separation is sent to a tailing solvent recovery unit (TSRU) to recover residual solvent.

Conventional settler/separation operations implement a counter-current, multi-stage system to produce two streams, a solvent-rich diluted bitumen product (which includes some asphaltenes), and an underflow tailings stream containing solids, water, bitumen, solvent and precipitated asphaltenes.

In a solvent recovery unit (SRU), a distillation column is employed for recovering relatively volatile solvent from the solvent-rich diluted bitumen product and delivering a clean, solvent-free, bitumen product and solvent stream for reuse.

In a tailings solvent recovery unit (TSRU), residual solvent in the settler underflow stream is recovered to ensure that a final tailings stream contains minimal amounts of residual solvent. Conventionally, a TSRU vessel is a flash tower into which the hot, pressurized tailings stream is released, resulting in rapid vaporization of the bulk of the residual solvent from the tailings. Steam may be added to further scavenge solvent from the tailings.

Two prior art processes which implement counter-current processes are Canadian Patent application 2,454,942 to True North Energy and Canadian patent 2,521,248 to Shell et al.

CA 2,454,942 describes a process in which a low-molecular weight paraffin is used as the solvent in a two-stage settler configuration. Underflow from a first stage settler is directed as influent to a second stage settler. In this process, the only introduction of solvent is by addition to the influent of the second stage settler, and the second stage settler overflow is recycled to the influent of the first stage settler. The overflow product of the first stage settler is the final product to the SRU. Accordingly, solvent is only added to the first stage settler by recycling back from the second stage settler overflow. The process is known as a counter-current process as the solvent flows counter-currently to the flow of froth. The second stage underflow is the influent to the TSRU.

CA 2,521,248 describes a process which applies three settlers. As in the True North process, there is a recycling of the overflow from the second stage settler to the influent of the first stage settler. The second stage overflow contains mainly solvent and diluted bitumen. Further, the overflow of the third stage settler is recycled back to the influent of the second stage settler. The overflow product of the first stage settler is the final product to the SRU. The only introduction of solvent is by addition to the influent of the third stage settler, and therefore solvent is only recycled to the first and second stage settlers by recycling back from the third stage settler. Again, a counter-current process is described with the overflow product of the first stage settler being the final diluted bitumen product to the SRU and the third stage underflow being the influent to the TSRU.

Other than the diluted bitumen product stream, each of the True North and Shell processes result in a single, high water content waste stream for downstream processing in the TSRU. The True North process results in about 7% of the bitumen in the froth being precipitated as asphaltenes and lost to the tailings. Asphaltenes are not a desirable component in a tailings stream or the bitumen product stream.

There is a need for recovering at least some of the asphaltenes otherwise lost to the tailings for reducing environmental impact, or for other beneficial purposes. Further, improved handling of the asphaltenes fraction can result in reduced asphaltene content in the diluted bitumen product. Simply, there are synergistic objectives to reduce hydrocarbon loss in tailings and to recover a valuable product from what is otherwise wasted.

SUMMARY OF THE INVENTION

The present invention provides a system, process and arrangement of separator stages and staged solvent addition which redirects asphaltenes preferentially from waste tailings to a new asphaltene by-product stream. As a result, the waste tailings contain a lower proportion of asphaltenes than heretofore achieved. Much of said asphaltenes are recovered in the asphaltene by-product stream that were otherwise lost to waste tailings in the prior art processes.

Paraffinic solvent is known to precipitate asphaltenes from bitumen froth. However, as disclosed herein, it has been discovered that use of controlled and multiple points of addition of paraffinic solvent, split between multiple stages of separators, and the arrangement of the separators cooperate to control the precipitation.

In embodiments of froth treatment disclosed herein, at least three stages of separation are provided. A first stage and a second stage are arranged in series, the underflow of the first stage flowing as influent to the second stage. The overflows of the first and second stages are combined as the influent to a third stage. Paraffinic solvent is added to the influent of the first stage and to the influent of at least one of the second or third stages. The solvent to bitumen ratio (S/B ratio) is controlled. As a result, three product streams are recovered: a waste tailings from the underflow of the second stage which is high in water and low in hydrocarbon fractions, a solvent-diluted bitumen stream from the overflow of the third stage and an asphaltene by-product stream from the underflow of the third stage which is also low in solids and low in water fractions. As asphaltene is a constituent of the bitumen, the recovery of bitumen in the diluted bitumen stream may be reduced slightly as asphaltenes are precipitated and redistributed between the waste tailings and asphaltene by-product stream. The precipitation of asphaltenes from the froth yields an improved quality or cleanliness of the diluted bitumen.

Simply, the embodiments herein manipulate asphaltene precipitation to best advantage. For example, solvent addition to the first stage can result in precipitation of asphaltenes which are lost to waste tailings, however, some asphaltene precipitation also aids in water and solids separation from the froth. Further, in an embodiment adding solvent addition to the second stage, asphaltenes can precipitate from bitumen in the first stage underflow and be lost to waste tailings, but will also result in additional recovery of bitumen from the second stage overflow for delivery to the third stage. All bitumen, including asphaltenes, reporting to the third stage is now recoverable. An overall S/B ratio achieved by confluence of at least the first and second stage overflows at the third stage, and optionally of a third stage solvent addition. This overall S/B ratio aids in the precipitation of asphaltenes for further asphaltene-cleaning of the bitumen for recovery as a dilute bitumen product and recovery of the precipitated asphaltenes as an asphaltene by-product.

In one embodiment, the paraffinic solvent is split between the first and second stages. Paraffinic solvent is added to the first stage in an S/B ratio which is below or in the vicinity of about a conventional asphaltene precipitation threshold. On the other hand, when paraffinic solvent is then added to the second stage, as a result of the influent to said second stage having a reduced bitumen fraction, this second solvent addition S/B ratio is much higher than a conventional asphaltene precipitation threshold.

In embodiments, the overall S/B ratio for the system remains comparable to that applied in conventional counter-current processes, however, having been applied in several stages.

In another embodiment, solvent is added to the influent of the first stage and to each of the influents of the second and third stages of separation.

Each stage of the separation can be conducted in conventional froth settlers. Alternate separators include centrifuges and hydrocyclones where appropriate. Centrifuges could be particularly suited at the first stage.

Accordingly, in one aspect of the invention, a process for treating bitumen froth comprises: directing the froth and a first paraffinic solvent as a first influent to a first stage separator. A first underflow from the first stage separator is directed to a second stage separator. A first overflow from the first stage separator is combined with a second overflow from the second stage separator as a third influent to a third stage separator. A second underflow is produced from the second stage separator as a waste tailings. At least a second paraffinic solvent is added to at least one of the second influent or third influent. Finally, a third overflow from the third stage separator is produced as a diluted bitumen product, and a third underflow from the third stage separator is produced as an asphaltene by-product.

In one embodiment, the at least a second paraffinic solvent is a second solvent added to the second influent. In another embodiment, the at least a second paraffinic solvent is a second solvent added to the third influent. In yet another embodiment, the at least a second paraffinic solvent comprises two solvent additions: a second solvent added to the second influent and a third solvent added to the third influent.

The first paraffinic solvent is added for precipitating little or substantially no asphaltenes, thereby minimizing losses to tailings. The at least a second paraffinic solvent is added to control the fraction of asphaltene reporting at the third underflow. Hydrocarbon loss is minimized at the waste tailings and overall bitumen recovery is maximized.

DESCRIPTION OF THE PREFERRED EMBODIMENTS

Paraffinic solvent is added to a bitumen-rich froth which enables separation of the mineral and water contaminants and production of a marketable bitumen product. Paraffinic solvent is admixed with froth and introduced to a froth separator. The solvent dissolves in the bitumen fraction of the froth. An amount of solvent added is typically referred to in terms of a solvent to bitumen ratio (S/B ratio).

Conventionally, sufficient paraffinic solvent is added to the froth to precipitate asphaltenes. The diluted solvent/bitumen hydrocarbon phase is less dense than the mineral, water and precipitated asphaltenes. Further, during the separation process, precipitated asphaltenes have the beneficial effect of capturing incremental mineral and water that would otherwise not have been separated out of the hydrocarbon phase. Generally speaking, the greater the asphaltene precipitation, the cleaner will be the diluted bitumen product obtained after the separation is complete, this cleaner diluted bitumen product having a lower asphaltene content.

In an embodiment of the invention, a flow-through froth treatment process comprises a process and system for introducing paraffinic solvent to bitumen-rich froth and separating a solvent-diluted bitumen therefrom in at least three stages of separation, one result being the formation of a new, asphaltene by-product stream.

In the embodiments described herein, each of multiple stages of separation may also be referred to as settlers, although other separation processes could also be employed including centrifuges and hydrocyclones. Accordingly, except where the context is expressly otherwise, the term "settlers" is also to be read broadly as a separator which happens to include at least settlers, centrifuges and hydrocyclones.

Figure 1:
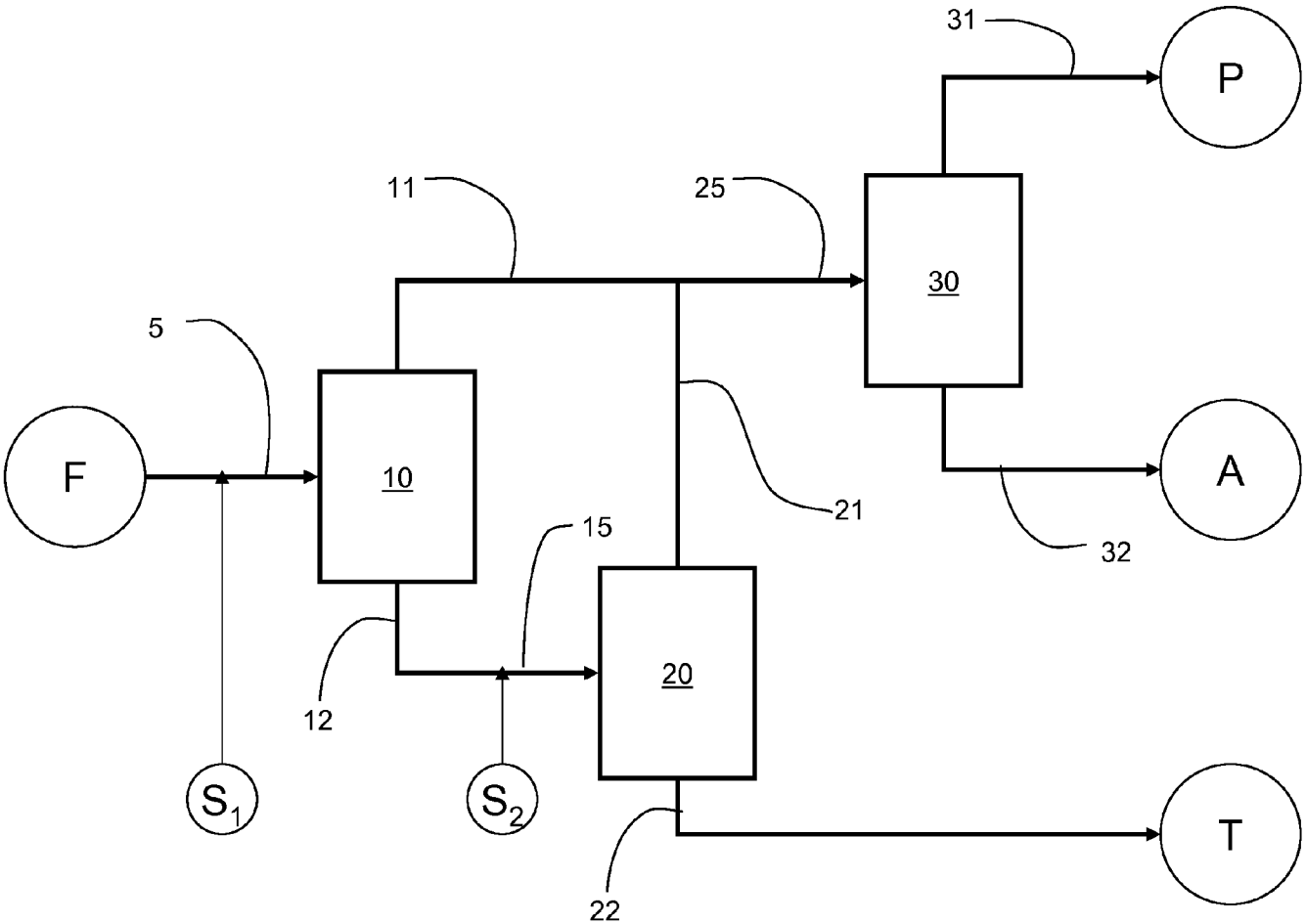
FIG. 1 is a flow diagram of an embodiment of a froth treatment process of the present invention having two stages of solvent addition.

Having reference to FIG. 1, froth F is directed as a part of a first stage influent or first influent 5 to a first stage separator 10. A first solvent S1 is added to the froth F to form part of the first influent 5. A first underflow 12 from the first stage settler 10 is directed to form part of a second stage influent or second influent 15 to a second stage settler 20.

A second solvent S2 is added to the first underflow 12 and forms part of the second influent 15 to the second stage settler 20. A second underflow 22 from the second stage settler 20 is produced as a waste tailings T.

A first overflow 11 from the first stage settler 10 is directed to form part of a third stage influent or third influent 25 which is directed to a third stage settler 30.

A second overflow 21 from the second stage settler 20 is also directed to and forms a part of the third influent stream 25 to the third stage settler 30.

A third overflow 31 from the third stage settler 30 is produced as a diluted bitumen product P.

A third underflow 32 from the third stage settler 30 is produced as an asphaltene by-product A.

The introduction of an asphaltene by-product A permits the process to control asphaltene distribution. The prior art is constrained to balance the need for asphaltene precipitation between competing objectives. On one hand, the prior art encourages precipitation of asphaltenes to aid in froth separation but, on the other hand, precipitated asphaltenes are lost with the tailings. In CA 2,454,942 at page 24, it was recognized that since asphaltenes are essentially hydrocarbons, their precipitation during the separating step should be managed to minimize loss of hydrocarbons from the diluted bitumen component and to minimize the amount of precipitated asphaltenes which are contained in the tailings component. The process disclosed in CA 2,454,942 limited their implementation of those objectives.

Herein, asphaltene precipitation can now be controlled so as to aid in froth treatment and yet also to redistribute precipitated asphaltenes for reducing losses in the waste tailing T and recovering precipitated asphaltenes in the new asphaltene by-product A. Further, the diluted bitumen product P is cleaner, having been liberated of some asphaltenes. Further, the asphaltene by-product stream A happens to be characterized by a low water and low mineral content.

Herein, any one or more of the first, second or third stage settlers 10,20,30 can comprise one or more physical separators to meet the process requirements. Conventional separation vessels can be employed including settlers such as vertical and inclined plate settlers. Other separation vessels include centrifuges or hydrocyclones.

In an embodiment of the invention, the waste tailing stream T is directed to a tailing treatment process such as a TSRU. The diluted bitumen product P is directed to a SRU. The asphaltene by-product stream A is directed for further processing or use.

As shown, solvent is added in at least two stages, the first solvent stream S1 being added to the froth F as part of the first influent 5 to the first stage settler 10. The second solvent stream S2 is added to at least a further stage, shown in FIG. 1 as forming part of the second influent 15 directed to the second stage settler 20. The adding of a second paraffinic solvent S2 to the second influent 15 comprises controlling a fraction of asphaltene reporting at the third underflow 32 from the third stage settler 30.

The combined, target or overall S/B ratio, that is (S1+S2)/B, provided to the froth treatment operations, can be conventional as is known by those of skill in the art. Various ranges of S/B ratios are known for other paraffinic froth treatment processes and which are dependant upon various parameters including the grade of the bituminous ore, the particular paraffinic solvent being used and the temperature of the operations. Known paraffinic solvents include C4 though C7, various mixtures thereof and natural gas condensate which includes alkanes of C5 through C16.

Again, as set forth in CA 2,454,942, one view is that asphaltenes tend to exhibit greater solubility in longer chain paraffinic solvents than in shorter chain paraffinic solvents, with the result that the amount of asphaltenes precipitated decreases as the selected paraffinic solvent becomes heavier or longer chained. Asphaltene precipitation is therefore generally greater in pentane than it is in hexane, heptane or octane. The precipitation of asphaltenes from the bitumen froth stream is also dependent upon the selection of the operating temperature for the separating step. The amount of asphaltenes precipitated from a particular solvent will generally decrease as the operating temperature is increased. Finally, the precipitation of asphaltenes from the bitumen froth stream is also dependent upon the amount of diluent solvent which is added to the bitumen froth stream. The amount of asphaltenes precipitated from a particular solvent will generally increase as the amount of the solvent, S/B ratio, increases.

A common and conventional range of overall S/B ratio is about 1 to about 2.

In the embodiment of FIG. 1, the solvent S1,S2 is introduced as part of the first and second influents 5,15 respectively and the total solvent is therefore split between the first and second stage settlers 10,20. The amount of solvent 51,52 added is controlled through the control of the S/B ratio.

The first solvent S1 is added to the bitumen froth F and the mixture forms the first influent 5 to the first stage settler 10. The amount of the first solvent S1 is controlled in order to have an S/B ratio below, up to or in the vicinity of about an asphaltene precipitation threshold. In prior art processes, a typical S/B ratio would be selected so as to be at or above an asphaltene precipitation threshold, for example at about 1.5 for the conventional two-stage, counter-current froth treatment process. The prior art process has one opportunity, at the first stage vessel, to recover a diluted bitumen product. Greater S/B ratios are known to result in greater asphaltene precipitation.

Herein, in contrast to the prior art processes, one embodiment applies an S/B ratio of the first solvent S1 at a first addition S/B ratio which is non-zero and can be up to and about the asphaltene precipitation threshold for the conditions present at the first stage settler. In contra-distinction to the prior art, this approach results in little or substantially no asphaltene precipitation. In the exemplary embodiment of FIG. 1 and corresponding Examples A, B, C and D, using substantially pentane as the first stage solvent S1, the first addition S/B ratio ranges from about 0.7 to about 0.9.

Consequently, the first stage settler 10 produces a first underflow 12 containing mainly solids, water, with a small amount of bitumen, and the possibility of a small amount of precipitated asphaltenes. Most of the water and solids are separated or dropped out, at least in part as a result of the first solvent S1. As discussed, the first additional S/B ratio is generally lower compared to the prior art and the asphaltene precipitation threshold. The first overflow 11 produced by the first stage settler 10 contains diluted bitumen, water, and solids. The diluted bitumen includes any asphaltenes not reporting to the first underflow 12.

The second solvent S2 is then added at a second addition S/B ratio to the first stage settler's first underflow 12 and the mixture is directed as second influent 15 to the second stage settler 20. As the amount of diluted bitumen remaining in the first underflow 12 is already low, the low magnitude of the bitumen denominator results in a second addition S/B ratio, entering the second stage settler 20, which is very high. Consequently, a large fraction or substantially all the residual asphaltenes in the bitumen flowing to the second stage settler 20 are precipitated. Precipitated asphaltenes are removed with the second underflow 22 to the waste tailings T along with essentially all the mineral and water entering the second stage settler 20. In this embodiment, the amount of solvent S2 added in the second stage settler 20, the second addition S/B ratio, is adjusted to control the rejection of asphaltene from the overall process.

The first and second overflows 11 and 21 from the first and second stage settlers 10,20 respectively are combined and directed as the influent stream 25 to the third stage settler 30 with an overall S/B ratio which is at about conventional S/B ratios. For paraffinic solvents which are substantially pentane, the overall S/B ratio is about 1.25 or could be higher.

As a result, the water and solids content in the third stage underflow 32 is low, and the asphaltenes therein are recoverable in the asphaltene by-product A.

Figure 2:
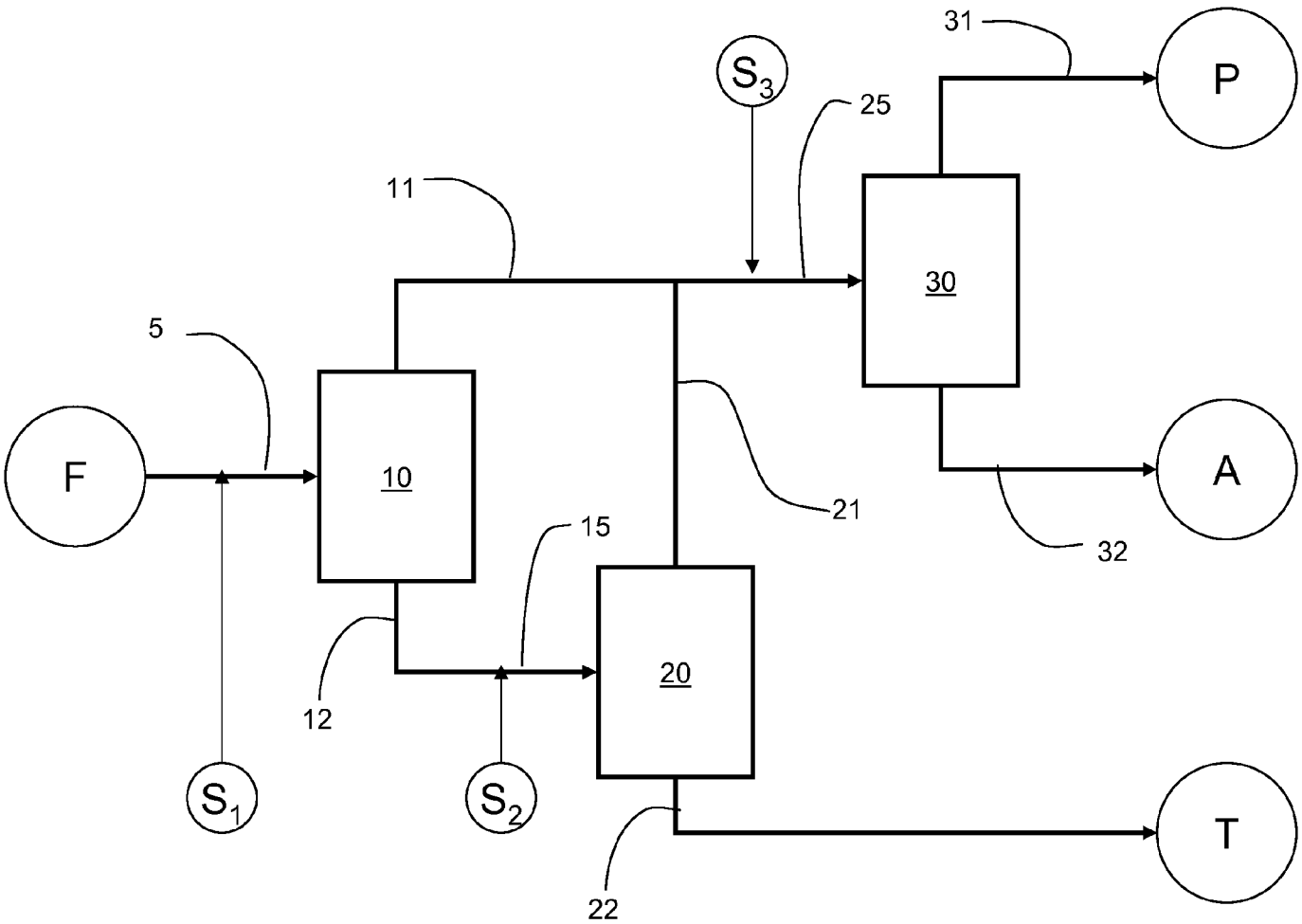
FIG. 2 is a flow diagram of an embodiment of a froth treatment process of the present invention having three stages of solvent addition.

With reference to FIG. 2, in an optional embodiment, a third stream of solvent S3 could be added to form part of the third stage influent stream 25. Solvent S3 is added so as to more finely manage asphaltene precipitation and control the asphaltene by-product stream A from the third settler 30. The second addition S/B ratio is reduced to accommodate a third addition S/B ratio, the overall S/B ratio (S1+S2+S3)/B still being about conventional for known paraffinic froth treatment operations.

The water content in the third settler underflow 32 can be controlled by controlling the S/B ratios in each of the first and second stage settlers 10,20, and optionally the third stage settler 30. For example, if it is desirable to reduce water and solid content, more solvent S1 can be added in the first stage settler 10. If more asphaltene precipitation is desired, the S/B ratio at the third influent stream 25 to the third stage settler 30 can be increased by adjusting the solvent S2 addition to the second stage settler 20, or also by adding the optional solvent S3 to the third influent 25 of the third stage settler 30.

Test results have shown that water and solids content in the third stage settler underflow 32 can be about 25% or less which means that, having a hydrocarbon content contributed mostly by asphaltene and residual solvent, this asphaltene by-product stream A can be used as fuel either before or after additional processing to remove solvent and/or water.

EXAMPLES

Bitumen comprises maltenes and asphaltenes. Froth F comprises bitumen, water and minerals. All percentages are in weight %.

Exemplary samples used in testing were as follows in Table 1:

TABLE 1

Froth for Examples A-E

| Component | Examples A, B, C wt % | Examples D, E wt % |
|---|---|---|
| Bitumen | 67.4 | 57.2 |
| Water | 23.8 | 34.7 |
| Mineral | 8.8 | 8.1 |
| Total | 100.0 | 100.0 |
| Of the bitumen in the froth, % asphaltenes | 17.9 | 19.5 |

Laboratory programs were conducted to assess different locations for multiple solvent addition and the effect on the redistribution of asphaltenes.

Examples A, B and C

Table 2 outlines the parameters in the paraffinic tests for the embodiment shown in FIG. 1 and Tables 2A, 2B and 3C present the results. The solvent used was substantially pentane and the tests were conducted at 80° C. Each test happens to have been repeated using a demulsifier introduced to the first stage without significant adverse or beneficial effect.

TABLE 2

Examples A, B, C - Test Matrix for Paraffin Solvent

| TEST | S/B in each stage based on FIG. 1: First stage 10 S1/B | Second Stage 20 S2/B | Overall S/B Target by Third Stage 30 (S1 + S2)/B |
|---|---|---|---|
| A | 0.7 | 11.5 | 1.25 |
| B | 0.8 | 9.8 | 1.25 |
| C | 0.9 | 5.5 | 1.25 |

Tables 2A, 2B and 2C report the recovery of the original bitumen in the froth to the various products, rounded to the nearest 0.1%. For example, for Test A, the bitumen was recovered as follows: 88.6% to the diluted bitumen product P, 1.7% loss to waste tailings T and the balance of 9.7% in the asphaltene by-product A, for a total of 100% of the bitumen in the froth F. Asphaltenes are concentrated in the asphaltene by-product A. From Table 1, initially 17.9 wt % of the bitumen in the froth F was asphaltenes. In Test A, of the 9.7% of the bitumen recovered in the asphaltene by-product A, 42.5% was asphaltenes.

TABLE 2A

Examples A, B, C - Diluted Bitumen Product

| TEST | S/B 10 | Diluted Bitumen Product P (Stream 31): Bitumen recovery (%) | Water Content (wt %) | Solid Content (wt %) |
|---|---|---|---|---|
| A | 0.7 | 88.6 | <0.1 | 0.024 |
| B | 0.8 | 91.2 | <0.1 | 0.021 |
| C | 0.9 | 90.3 | <0.1 | 0.048 |

TABLE 2B

Examples A, B, C - Waste Tailings

| TEST | S/B 10 | Waste Tailings T (stream 22): Bitumen loss (%) | Solvent Content (wt %) | Water Content (wt %) |
|---|---|---|---|---|
| A | 0.7 | 1.7 | 2.9 | 82.8 |
| B | 0.8 | 2.0 | 2.7 | 93.5 |
| C | 0.9 | 3.7 | 0.3 | 86.0 |

It is understood that the prior art processes result in 8 to 10% of the bitumen reporting to the waste tailings stream, see J. H. Masliyah, "*Extraction and Upgrading of Bitumen*", workshop Jun. 24 & 25, 2009, Calgary, p. B5-23. Examples A-C illustrate that bitumen loss to the waste tailings is significantly reduced and, correspondingly, difficulties and environmental aspects are reduced also.

TABLE 2C

| Examples A, B, C - Asphaltene By-Product | | | | | | |
|---|---|---|---|---|---|---|
| | | Asphaltene By-Product A (Stream 32) | | | | Overall Bitumen Recovery |
| TEST | S/B 10 | Bitumen Recovery (%) | Asphaltene Content (wt % of Bitumen) | Water Content (wt %) | Solids Content (wt %) | (31 + 32) (wt %) |
| A | 0.7 | 9.7 | 42.5 | 18.5 | 6.5 | 98.3 |
| B | 0.8 | 6.8 | 40.9 | 20.0 | 5.2 | 98.0 |
| C | 0.9 | 6.0 | 41.3 | 18.9 | 5.8 | 96.4 |

The asphaltene by-product A is further characterized by a low water and a low mineral content. In the prior art, there is no asphaltene by-product A at all, and this otherwise recoverable bitumen is needlessly lost to tailings.

As noted above, the asphaltene by-product A of Table 2C is combustible, having value as a fuel or other source of hydrocarbon.

Examples D, E

Tests for Examples D and E are additional tests performed at a different laboratory and using a different froth composition (see Table 1). Example D, like Examples A-C, has solvent addition to two stages of separation according to FIG. 1.

Example E is a test using solvent addition to all three stages of separation according to FIG. 2. It was expected that the use of solvent addition to the third stage settler 30 would further decrease the amount of precipitated asphaltene lost to the waste tailings T. Accordingly, the second addition S/B ratio to second settler 20 was decreased with third addition S/B ratios of <3 targeted with the objective of decreasing the amount of asphaltene precipitated in the second stage settler 20 and accordingly reporting to waste tailings T. With reference to Tables 3A, 3B and 3C, the recovery of the original bitumen in the froth 5 is illustrated for the various product streams 22, 31 and 32.

TABLE 3A

| Examples D, E - Diluted Bitumen Product | | | | |
|---|---|---|---|---|
| | | Diluted Bitumen Product P (Stream 31) | | |
| TEST | S/B 10 | Bitumen recovery (%) | Water Content (wt %) | Solid Content (wt %) |
| D | 0.8 | 92.5 | 0.04 | 0.05 |
| E | 0.8 | 92.9 | 0.01 | 0 |

In this additional testing of Examples D and E, both the two-way split solvent addition and the three-way split solvent addition, respectively, produced comparable diluted bitumen recovery relative to Examples A, B and C.

TABLE 3B

| Examples D, E - Waste Tailings | | | | |
|---|---|---|---|---|
| | | Waste Tailings T (stream 22) | | |
| TEST | S/B 10 | Bitumen loss (%) | Solvent Content (wt %) | Water Content (wt %) |
| D | 0.8 | 2.9 | 8.11 | 70.1 |
| E | 0.8 | 4.1 | 17.7 | 62.8 |

Similarly, the Examples D and E consistently resulted in low bitumen losses to the wasted tailings.

TABLE 4C

| Examples D, E - Asphaltene By-Product | | | | | | |
|---|---|---|---|---|---|---|
| | | Asphaltene By-Product (Stream 32) A | | | | Overall Bitumen Recovery |
| TEST | S/B 10 | Bitumen Recovery (%) | Asphaltene Content (wt % of Bitumen) | Water Content (wt %) | Solids Content (wt %) | (31 + 32) (wt %) |
| D | 0.8 | 4.6 | 35.0 | 5.6 | 6.0 | 97.1 |
| E | 0.8 | 3.0 | 46.0 | 0.35 | 0.8 | 95.9 |

The water and solids content in the asphaltene by-product of Examples D and E were consistently low, the overall recovery of bitumen at streams 31 and 32 was comparable to those from Examples A, B and C, the overall recovery of bitumen was improved over those recovered at the sole diluted bitumen product stream of the prior art.

The embodiments of the invention for which an exclusive property or privilege is claimed are defined as follows:

1. A process for bitumen froth treatment comprising:

in a flow-through process, directing the froth and a first paraffinic solvent as a first influent to a first stage froth treatment separator;

directing a first underflow from the first stage froth treatment separator as a second influent to a second stage froth treatment separator;

combining a first overflow from the first stage froth treatment separator and a second overflow from the second stage froth treatment separator as a third influent to a third stage froth treatment separator;

producing a second underflow from the second stage froth treatment separator as a waste tailings;

adding at least a second paraffinic solvent to at least one of the second influent or the third influent;

producing a third overflow from the third stage froth treatment separator as a diluted bitumen product; and producing a third underflow from the third stage froth treatment separator as an asphaltene by-product, wherein the first underflow flows through to the second stage froth treatment separator to report as either the second overflow or the waste tailings, the first overflow flows through to the third stage froth treatment separator to report as either the diluted bitumen product or the asphaltene by-product; and the second overflow flows directly through to the third stage froth treatment separator to report as either the diluted bitumen product of the asphaltene by-product.

2. The process of claim 1 wherein the adding of the at least a second paraffinic solvent comprises adding the at least a second paraffinic solvent to the second influent.

3. The process of claim 1 wherein the adding of the at least a second paraffinic solvent comprises adding the at least a second paraffinic solvent to the third influent.

4. The process of claim 1 wherein the adding of at least the second paraffinic solvent comprises adding the at least a second paraffinic solvent to the second influent and adding the at least a second paraffinic solvent to the third influent.

5. The process of claim 1 wherein the adding of at least the second paraffinic solvent comprises adding the at least a second paraffinic solvent to the second influent and adding a third paraffinic solvent to the third influent.

6. The process of claim 1 wherein the first paraffinic solvent and the at least a second paraffinic solvent are substantially pentane and wherein an overall solvent/bitumen ratio is about 1.25 or higher.

7. The process of claim 1 wherein the adding of at least a second paraffinic solvent comprises:

adding the at least a second paraffinic solvent to the second influent; and wherein the first paraffinic solvent and the at least a second paraffinic solvent are substantially pentane and wherein an overall solvent/bitumen ratio is about 1.25 or higher.

8. The process of claim 1 wherein the adding of the at least a second paraffinic solvent comprises:

adding the at least a second paraffinic solvent to the third influent; and wherein the first paraffinic solvent and the at least a second paraffinic solvent are substantially pentane and wherein an overall solvent/bitumen ratio is about 1.25 or higher.

9. The process of claim 1 wherein the adding of at least the second paraffinic solvent comprises adding the at least a second paraffinic solvent to the second influent and adding the at least a second paraffinic solvent to the third influent; and wherein the first paraffinic solvent and the at least a second paraffinic solvent are substantially pentane and wherein an overall solvent/bitumen ratio is about 1.25 or higher.

10. The process of claim 1 wherein the adding of at least the second paraffinic solvent comprises:

adding the at least a second paraffinic solvent to the second influent;

adding a third paraffinic solvent to the third influent; and wherein the first paraffinic solvent, the at least a second paraffinic solvent, and the third paraffinic solvent are substantially pentane and wherein an overall solvent/bitumen ratio is about 1.25 or higher.

11. The process of claim 1 wherein the adding of the first paraffinic solvent to the first influent comprises adding the first paraffinic solvent so as to control a first addition S/B ratio in the first stage froth treatment separator for minimizing asphaltene precipitation in the first stage froth treatment separator.

12. The process of claim 11 wherein the first addition S/B ratio is controlled between an S/B ratio below an asphaltene precipitation threshold and an S/B ratio up to about the asphaltene precipitation threshold.

13. The process of claim 12 wherein the first paraffinic solvent is substantially pentane and the first addition S/B ratio is non-zero and up to about 0.9.

14. The process of claim 11 wherein the adding of the at least a second paraffinic solvent to the second influent or the third influent comprises controlling an amount of the at least a second paraffinic solvent to control the fraction of asphaltene reporting at the third underflow.

15. The process of claim 1 wherein the adding of the at least a second paraffinic solvent to the second influent or the third influent comprises controlling an amount of the at least a second paraffinic solvent to control the fraction of asphaltene reporting at the third underflow.

16. The process of claim 15 wherein the adding of the at least a second paraffinic solvent to the second influent or the third influent comprises adding the at least a second paraffinic solvent to the second influent.

17. The process of claim 15 wherein the adding of the at least a second paraffinic solvent to the second influent or the third influent comprises adding the at least a second paraffinic solvent to the third influent.

18. The process of claim 15 wherein the adding of the at least a second paraffinic solvent to the second influent or the third influent comprises adding the at least a second paraffinic solvent to the second influent and adding the at least a second paraffinic solvent to the third influent.

19. The process of claim 1 wherein the first stage froth treatment separator, the second stage froth treatment separator and the third stage froth treatment separator are settlers.

20. The process of claim 1 wherein the first stage froth treatment separator is selected from the group of separators consisting of settlers, centrifuges and hydrocyclones.

21. The process of claim 1 wherein the first stage froth treatment separator, the second stage froth treatment separator and the third stage froth treatment separator are selected from the group consisting of settlers, centrifuges and hydrocyclones.

* * * * *